US005645795A

United States Patent [19]

Ban

[11] Patent Number: 5,645,795

[45] Date of Patent: Jul. 8, 1997

[54] ALLOY COMPOSITION FOR A TRANSMISSION GEAR OF AN AUTOMIBLE

[75] Inventor: Hyoung-oh Ban, Kyungsangnam-do, Rep. of Korea

[73] Assignee: Hyundai Motor Company, Seoul, Rep. of Korea

[21] Appl. No.: 366,590

[22] Filed: Dec. 29, 1994

[30] Foreign Application Priority Data

Dec. 30, 1993 [KR] Rep. of Korea ..... 93-31613

[51] Int. Cl.[6] ..... C22C 38/44; C22C 38/46; C22C 38/48

[52] U.S. Cl. ..... 420/109

[58] Field of Search ..... 420/109, 110; 148/335

[56] References Cited

U.S. PATENT DOCUMENTS 3,889,350 6/1975 Mocarski .
4,091,904 5/1978 Beyer .
4,225,365 9/1980 Rice .
4,285,739 8/1981 Deruyttere et al. .
4,874,439 10/1989 Akutsu .
4,995,924 2/1991 Akutsu .
5,114,468 5/1992 Akutsu et al. .
5,242,758 9/1993 Hitchcock et al. .
5,454,883 10/1995 Yoshie et al. ..... 148/335

FOREIGN PATENT DOCUMENTS 58-204161 11/1983 Japan ..... 148/335

*Primary Examiner*—Deborah Yee
*Attorney, Agent, or Firm*—Finnegan, Henderson, Farabow, Garrett & Dunner

[57] ABSTRACT

An alloy composition is disclosed for a transmission gear of an automobile containing increased amounts of a component such as nickel to improve the quenching properties, increased amounts of niobium, and reduced amounts of components having a strong oxygen affinity, the alloy thereby having improved purity and fatigue strength.

1 Claim, 2 Drawing Sheets

ALLOY COMPOSITION FOR A TRANSMISSION GEAR OF AN AUTOMIBLE

BACKGROUND OF THE INVENTION

1. Field of the Invention

The present invention relates to an alloy composition for a transmission gear of an automobile containing increased amounts of components for improving the quenching properties, such as nickel, increased amounts of niobium, and reduced amounts of components having a strong oxygen affinity, in order to improve the purity and fatigue strength of the alloy.

2. Description of the Related Art

Chromium, Cr—Mo, and Cr—Mo—Ni steel alloys have been used for transmission gears of automobiles. These alloy compositions attain the desired quenching hardness and hardening depth during the carburizing heat treatment by increasing the content of Cr, Mo, and Ni in a low-steel typically used for manufacturing machine parts. However, these alloys form an abnormal surface layer during the carburizing heat treatment due to the presence of components having a strong oxygen affinity, such as manganese, silicon, and chromium. For this reason, these alloys are limited in their ability to improve the strength of the material to the level required to withstand the increasing stress created by the transmission load during a rise in engine power.

To solve this problem, according to the present invention, the amounts of manganese, silicon, and chromium, which have a strong oxygen affinity and poor quenching properties, were decreased, and the amounts of nickel and molybdenum, which have a weak oxygen affinity, good quenching properties, and desirable structure intensification properties, were increased. Niobium and vanadium were added to restrain the growth of crystal grains.

SUMMARY OF THE INVENTION

The present invention relates to an alloy composition for a transmission gear of an automobile consisting essentially of 0.15–0.25 wt. % carbon, 0.10–0.15 wt. % silicon, 0.45–0.65 wt. % manganese, 0–0.015 wt. % phosphorous, 0–0.015 wt. % sulfur, 1–2.5 wt. % nickel, 0.5–0.6 wt. % chromium, 0.4–0.8 wt. % molybdenum, 0.02–0.06 wt. % niobium, 0.02–0.06 wt. % vanadium, 0–0.3 wt. % copper, and the remainder iron and inevitable impurities. The alloy composition has excellent purity and exhibits desirable fatigue strength.

BRIEF DESCRIPTION OF THE DRAWINGS

FIG. 1(*b*) is an electron microscope photograph of the surfaces of the alloy compositions according to Example 2 of the present invention (magnification 1300-fold).

FIG. 2(*b*) is an electron microscope photograph of the surfaces of the alloy compositions according to Comparative Example 2 of the present invention (magnification 1300-fold).

DETAILED DESCRIPTION OF THE INVENTION

Figure 1A:
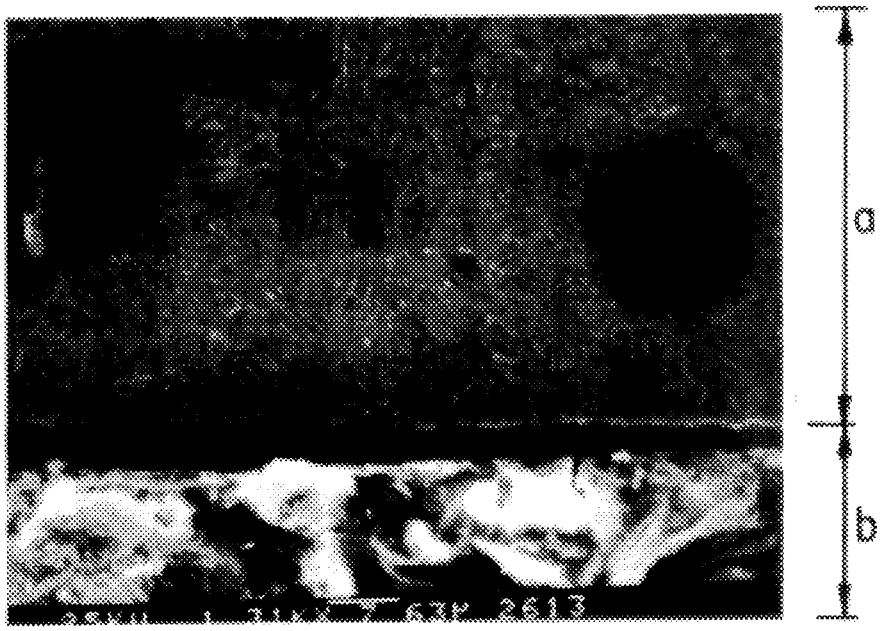
FIG. 1(*a*) is an electron microscope photograph of the surfaces of the alloy compositions according to Example 1 of the present invention (magnification 1310-fold).

According to the present invention, the content of manganese and similar components in a steel is decreased while the content of molybdenum and similar components is increased and niobium and similar components are added. The resultant alloy has increased purity and improved fatigue strength.

In the alloy of the present invention, carbon is used in am amount of 0.15 to 0.25 wt. %, which is an amount commonly used in steels. If the carbon content is over 0.25 wt. %, the toughness decreases due to excessive martensite formation in the surface of the steel during the carburizing heat treatment.

Silicon, manganese, and chromium may be used in amounts of 0.10–0.15 wt. %, 0.45–0.65 wt. %, and 0.5–0.6 wt. %, respectively. If the amounts of these elements are below these ranges, the desired hardening depth can still be attained because the fragility will be controlled although the quenching properties are less desirable. If the amounts of these elements are above these ranges, an abnormal oxidizing surface layer may form during the carburizing heat treatment due to the high oxygen affinity of these elements. This layer often initiates fatigue fracture.

Phosphorous and sulfur may be present in amounts of 0–0.015 wt. % to provide improved machinability to the steel.

Nickel and molybdenum may be present in amounts of 1.0–2.5 wt. % and 0.4–0.8 wt. %, respectively, to decrease the oxygen affinity of the alloy, improve the quenching properties, and improve the reinforcing structure within the alloy. If the amount of nickel and molybdenum are below these ranges, the strength and toughness of the alloy may be decreased, and the quenching properties reduced. If the amount of nickel and molybdenum are above these ranges, the alloy may break more readily due to an increased amount of austenite.

Niobium and vanadium are included in amounts of 0.02–0.06 wt. % each. If these elements are not added, crystal grains may grow too readily and the strength of the alloy may be decreased.

As a result of the combination of the components discussed above in the amounts specified, the alloy of the present invention has excellent purity and fatigue strength in comparison with prior art compositions. This alloy is useful for transmission gears, industrial machine parts, or other uses recognized by one skilled in the art.

The present invention is further illustrated, but not limited, by the Examples below, which are intended to be exemplary only.

EXAMPLES 1, 2

Comparative Examples 1, 2

In accordance with the ratios shown in Table 1, the components for each alloy were blended by a vacuum degassing process in an electric furnace to obtain the desired compositions.

TABLE 1

| Components | Fe | C | Si | Mn | P | S | Ni | Cr | Mo | Nb | V | Cu |
|---|---|---|---|---|---|---|---|---|---|---|---|---|
| Example 1 | 96.307 | 0.15 | 0.18 | 0.55 | 0.013 | 0.012 | 1.57 | 0.52 | 0.58 | 0.025 | 0.023 | 0.07 |
| Example 2 | 96.563 | 0.21 | 0.17 | 0.60 | 0.015 | 0.014 | 1.00 | 0.58 | 0.69 | 0.021 | 0.027 | 0.11 |
| Comparative Example 1(1) | 97.334 | 0.20 | 0.19 | 0.83 | 0.021 | 0.015 | 0.08 | 1.03 | 0.21 | — | — | 0.09 |
| Comparative Example 2(2) | 96.902 | 0.23 | 0.17 | 0.81 | 0.020 | 0.008 | 0.19 | 1.21 | 0.33 | — | — | 0.13 |

(1):Steel meeting the specification SCM 420H (JIS G 4052)
(2):Steel meeting the specification SCM 722$H_2$-VI Experiment 1: Fatigue Strength by Antipitting Test pieces 5.0 mm in length and having a diameter of 55 mm were prepared from the alloys of Examples 1 and 2, and Comparative Examples 1 and 2. The test pieces were heat treated by a carburizing salt bath process (5.5 hours at 930° C.; salt hardening at 220° C.; quench hardening for 1.5 hours at 170° C.). The test was carried out under the following conditions: the effective hardening depth was controlled to 0.6–0.8 mm, three still balls were fixed on the bottom surface of the test piece, the rotation was at 1000 rpm; and the test load was 700 kgf/mm$^2$. If pitting occurred on the test pieces during rotation, the apparatus was stopped by an operating abnormal frequency sensor.

Test results are shown in Table 2.

TABLE 2

| Section | Cycles (× $10^6$) | | | | Average Cycles (× $10^6$) |
|---|---|---|---|---|---|
| Example 1 | 13.3 | 15.9 | 15.9 | 17.3 | 15.4 |
| Example 2 | 16.3 | 18.3 | 18.8 | 19.3 | 18.2 |
| Comparative Example 1 | 10.4 | 10.7 | 12.8 | 13.1 | 11.8 |
| Comparative Example 2 | 12.5 | 11.9 | 14.1 | 12.9 | 12.9 |

Experiment 2: Fatigue Strength Test by Rotary-Bending

Test pieces 90 mm in length and 12 mm in diameter shaped like double-headed drums pinched in the middle were prepared from the alloys of Examples 1 and 2, and Comparative Examples 1 and 2. The test pieces were heat-treated as in Experiment 1. The test was carried out using a fatigue strength tester under revolutions of 1730 to 1900 rpm and a test load of 35 to 60 kgf/mm$^2$ to obtain a fatigue limitation. Results are shown in Table 3.

TABLE 3

| Section | Fatigue limitation (kg · f/mm$^2$ |
|---|---|
| Example 1 | 101.5 |
| Example 2 | 94.5 |
| Comparative Example 1 | 79.5 |
| Comparative Example 2 | 90.5 |

As shown in Tables 2 and 3, the fatigue strength of the alloy of the present invention, as tested by antipitting, was 30–50% better than that of the conventional alloys of the Comparative Examples. Similarly, the fatigue strength of the alloy of the present invention, as tested by rotary bending, was 19–28% better.

Experiment 3: Observation for Abnormal Surface Layer

Figure 1B:
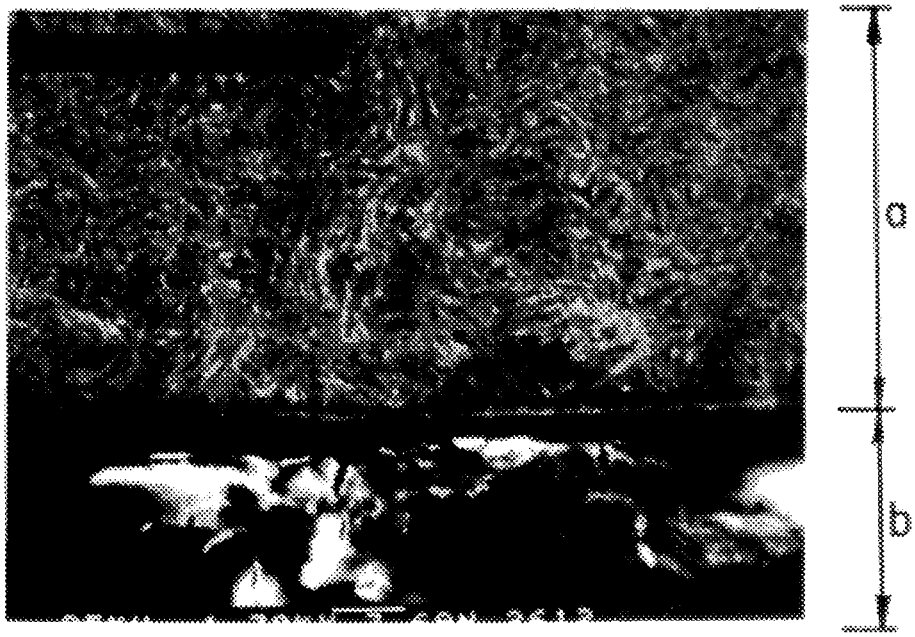
Figure 2A:
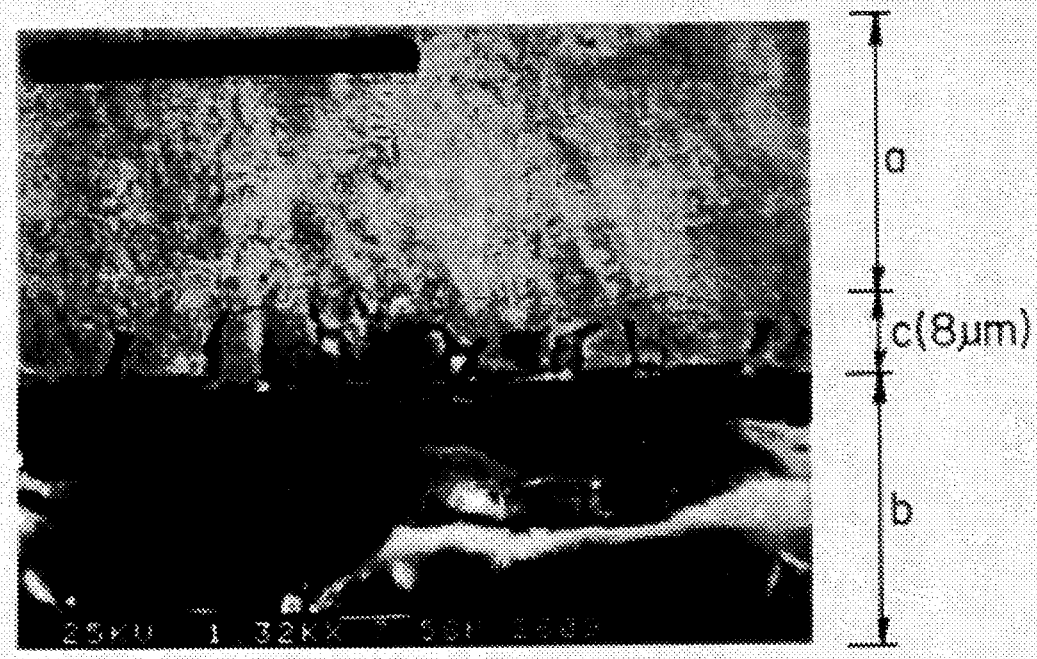
FIG. 2(*a*) is an electron microscope photograph of the surfaces of the alloy compositions according to Comparative Example 1 of the present invention (magnification 1320-fold).
Figure 2B:
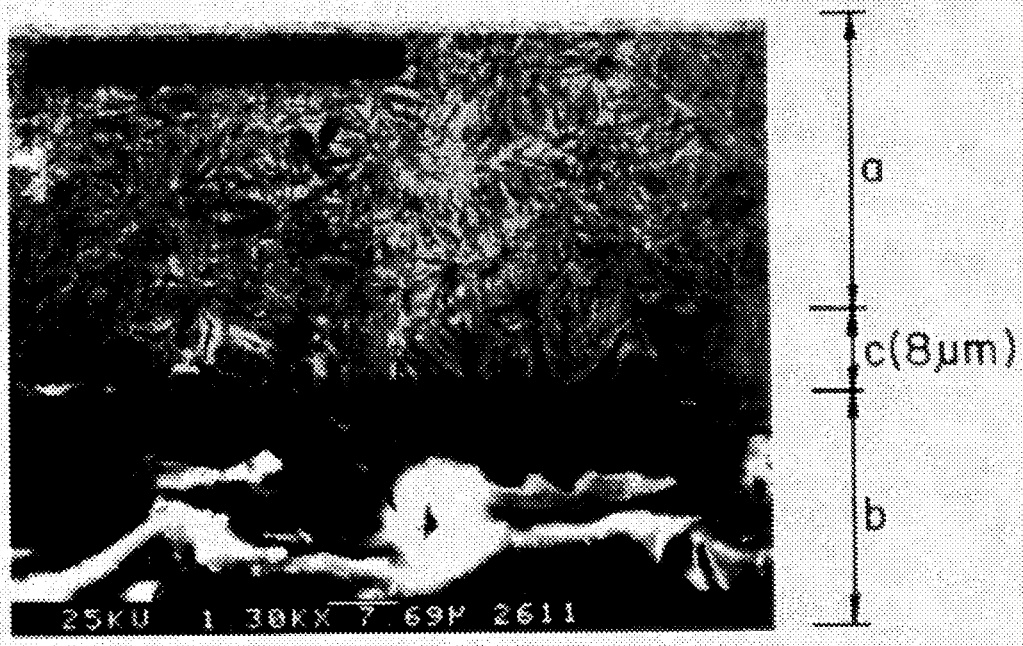

Electron microscope photographs of the surfaces of the steel alloys of Examples 1 and 2, and Comparative Examples 1 and 2 are shown in FIGS. 1(*a*) and 1(*b*), and 2(*a*) and 2(*b*), respectively. "a" indicates carburized organization, "b" indicates the mounting resin (Bakelite), and "c" indicates the abnormal surface layer. The photos clearly show that the alloys of the present invention are free from the undesirable abnormal surface layer.

What is claimed is:

1. An alloy composition for a transmission gear of an automobile consisting of 0.15–0.25 wt. % carbon, 0.10–0.15 wt. % silicon, 0.45–0.65 wt. % manganese, 0–0.015 wt. % phosphorus, 0–0.015 wt. % sulfur, 1–2.5 wt. % nickel, 0.5–0.6 wt. % chromium, 0.4–0.8 wt. % molybdenum, 0.02–0.06 wt. % niobium, 0.02–0.06 wt. % vanadium, 0–0.3 wt. % copper, and the remainder iron and inevitable impurities.

* * * * *